United States Patent [19]

Grüner et al.

[11] Patent Number: 4,485,425

[45] Date of Patent: Nov. 27, 1984

[54] DRIVE CIRCUIT FOR PRINTER, PARTICULARLY, MATRIX PRINTER OF THE NEEDLE OR HAMMER VARIETY

[75] Inventors: Manfred Grüner, Ulm; Bernd Gugel, Ulm-Einsingen, both of Fed. Rep. of Germany

[73] Assignee: Mannesmann AG, Duesseldorf, Fed. Rep. of Germany

[21] Appl. No.: 450,259

[22] Filed: Dec. 16, 1982

[30] Foreign Application Priority Data

Dec. 21, 1981 [DE] Fed. Rep. of Germany ..... 3151242

[51] Int. Cl.[3] ..... H01H 47/32

[52] U.S. Cl. ..... 361/153; 361/152

[58] Field of Search ..... 361/152, 153, 186

[56] References Cited

U.S. PATENT DOCUMENTS

| | | | |
|---|---|---|---|
| 3,660,730 | 5/1972 | Mason | 361/152 |
| 3,859,572 | 1/1975 | Keidl et al. | 361/153 |
| 4,399,483 | 8/1983 | Phelan | 361/152 X |

FOREIGN PATENT DOCUMENTS

| | | | |
|---|---|---|---|
| 0039629 | 3/1980 | Japan | 361/152 |

*Primary Examiner*—Reinhard J. Eisenzopf

*Attorney, Agent, or Firm*—Ralf H. Siegemund

[57] ABSTRACT

The drive circuit for an electromagnetic actuator for the impact element in a printer includes a series circuit of a drive transistor and of a switching transistor there being a reference resistor interposed which together with a Zener diode serves as a current limiter for the current through the drive transistor and the electromagnetic element. The two transistors are controlled in that each of the base electrodes is serially connected to the emitter collector path of a control transistor and the two control transistors in turn are connected to monostable multivibrators which are triggered concurrently but furnish pulses of different duration such that the switching transistor is turned off before the drive transistor. The current limiting permits utilization of residual electromagnetic energy from the preceding actuation pulse without incurring undue losses.

7 Claims, 4 Drawing Figures

DRIVE CIRCUIT FOR PRINTER, PARTICULARLY, MATRIX PRINTER OF THE NEEDLE OR HAMMER VARIETY

BACKGROUND OF THE INVENTION

The present invention relates to a drive circuit for printers and here particularly for printers of the matrix variety having needles or hammers as print impact elements.

These impact elements, needles or hammers, for matrix printers, usually are operated electromagnetically by means of solenoids. The solenoids receive brief current pulses which are timed by the printing program in general and result from a selective control of the respective impact print element pursuant to the generation of individual characters which are composed from individual dots, such dots being produced by the several impact elements. The electronic circuit included in such a printer is usually provided with a character generator which provides print or no print commands to each of the solenoid operated impact elements print or no-print. The electronic circuit includes particularly timed signal generators which determine the specific timing of printing as well as enabling signals which decide whether or not a particular solenoid is to be activated. These signal are passed through logic circuit and operate, for example, monostable multivibrators which when triggered provide pulses of fixed duration, these pulse determine the timing and duration of solenoid energization. The solenoid is immediately controlled through transistors which provide the requisite power for operating the solenoid while they themselves are controlled by the aforementioned monostable electronics.

In response to such a timed and duly amplified control pulse for a hammer or a needle, the solenoid causes the hammer or needle to be propelled forward to provide for the dot imprinting impact upon the sheet or the like to be printed on. Thereby it is feasible to operate directly electromagnetically in that the hammer or needle is in fact electromagnetically advanced and, for example, retracted after the impact by operation of a spring. Alternatively, the impact elements may normally be held back electromagnetically while the drive pulse current causes the magnetic holding field to collapse and now a spring can prevail to propel the impact element forward.

After an impact element has been advanced and retracted again, a relative shift in lateral direction is provided between the print head containing the needles or hammers and the sheet to be printed on. Depending upon the type of printer and the extent of print elements provided for, the next print step may involve just printing a different portion of the character or different portions of groups of characters, or, in the case of a strip printer, this strip may be advanced. Thus, sequential print cycles require some kind of shift between the sheet or strip printed on and the print head, hammer banks, etc.

Independent from the type of operation and generation of the overall print pattern and image, it is readily apparent that the overall print speed depends, on the one hand, on the speed with which the above mentioned shift from one print position to the next print position can be produced and additionally, the print speed depends on the repetition rate of energization of the solenoid or other electromagnetic structure operating the impact elements. In this regard it was found that the, for example, that the print head or hammer bank advance or even an incremental paper shift are the faster operations. The repetition rate of operating a print hammer or needle was found to be severely limited by the electromagnetic mode of operation and by the physical structure involved. The maximum rate attainable is usually called the limit frequency of operating such a hammer or print needle.

At the present time it is generally accepted that the needle printers have a limit frequency which does not exceed 2,000 impacts per second. However, even this number appears to be a theoretical limit only. The physical conditions for driving a print needle or print hammer usually do not permit the extension of the operating frequency up to the limit frequency. The reason for this is that the energy which is fed to the electromagnetic coil cannot be converted therein completely into kinetic energy for and in the impact element. Rather, a considerable amount and portion of that electrical energy is converted into waste heat. Aside from the loss in effectively usable energy, the printer and its operating elements may become quite warm, even hot, and transmit that heat into the immediate environment. This heat may in fact interfere with the head operation itself and it may also affect electronic circuit elements such as transistors and other semiconductor elements. Moreover, the life of the electronics when required to operate in a hot environment is reduced. Therefore, it has even been necessary in cases to provide for a forced cooling of the printer in order to remove the heat. Obviously, this is an increase in expenditure and bulkiness and renders the device more prone to break down. Moreover, maintenance of the printer is increased.

DESCRIPTION OF THE INVENTION

It is an object of the present invention to avoid undue heating of a print head or a hammer bank even if the impact elements of such a printer are operated at or close to the theoretical limit frequency. The purpose thereof is to avoid the necessity of a forced cooling and to increase the life of the elements which are subjected to the heat losses in and of the drivers of the impact element.

In accordance with the preferred embodiment of the invention, it is suggested to provide the control circuit for the electromagnetic actuator of the impact print elements in such a printer in that a current limitation through the driver is in fact operating for a certain period of time to obtain a uniform and a limited current through the electromagnetic actuator. The current pulse which will drive the electromagnetic actuator for such an impact print element will have the contour of a trapezoid. It was found that limiting the current in this fashion reduces drastically the heating of the environment including the print head elements, the hammers of a hammer bank or the like. Since the reduced current reduces the amount of dissipated heat, one can indeed operate the element at a frequency close to the theoretical limit frequency. The life of the print elements such as hammers, printing needles and associated equipment is increased despite of the increase in operating frequency. Moreover, it was found that a forced cooling, i.e., a supplementary cooling system for the printer and its moveable parts does not have to be provided for.

In the furtherance of the invention it is suggested that the current through the electromagnetic drive element and actuator be controlled by a drive transistor having its emitter collector path connected in series with that actuator and drive element and to provide a current limiting circuit such that a reference transistor and a Zener diode is connected between the base electrode thereof and the base emitter path reference resistor so that the constant voltage drop of the Zener diode forces the emitter current of the drive transistor to assume a constant value. The drive transistor and the reference resistor are further connected serially to a switching transistor and these two transistors are, through their respective base electrodes, controlled by pulses of different duration. Therefore, for the later part of the current pulse, the effective drive voltage is reduced.

As will be explained in detail below, the providing of a current limiting circuit has the added effect of permitting direct utilization of residual electromagnetic energy in the electromagnetic actuator that has remained therein during and after the preceding actuator pulse. This permits operation at a steeper rise time without significantly adding to the losses produced by and in the electromagnetic device and as compared with the situation when no current limiting is provided for.

It is of further advantage to provide the various electronic circuit elements including the current limiting and drive circuits, excepting however, the electromagnetic coil proper, upon a printed circuit board and to place that board remote from the electromagnetic actuator so that on one hand these elements are not heated by the current flow through the actuator while on the other hand any heating of the reference resistor is rendered ineffective if in fact that particular printed circuit board is placed in a location of the printer which is subjected to cooling generally. Therefore, the heat developed by and in the reference resistor will not influence the print head or the hammer bank.

DESCRIPTION OF THE DRAWINGS

While the specification concludes with clams, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 illustrates a solenoid or other electromagnetic device L1 into which an electric current is to be driven. The electromagnetic device L1 will operate a needle, print hammer or the like, denoted generally by P. Reference numeral 1*a* illustrates a print pulse which could also be termed an impact element select pulse. This pulse 1*a* is derived, for example, from a character generator and the absence or presence of such a pulse represents the participation of the particular impact element P in the current print cycle. Reference numeral 3*a* represents schematically a timing pulse whose occurence marks the instant in which printing is desired, provided of course the particular print element has been selected.

Figure 1:
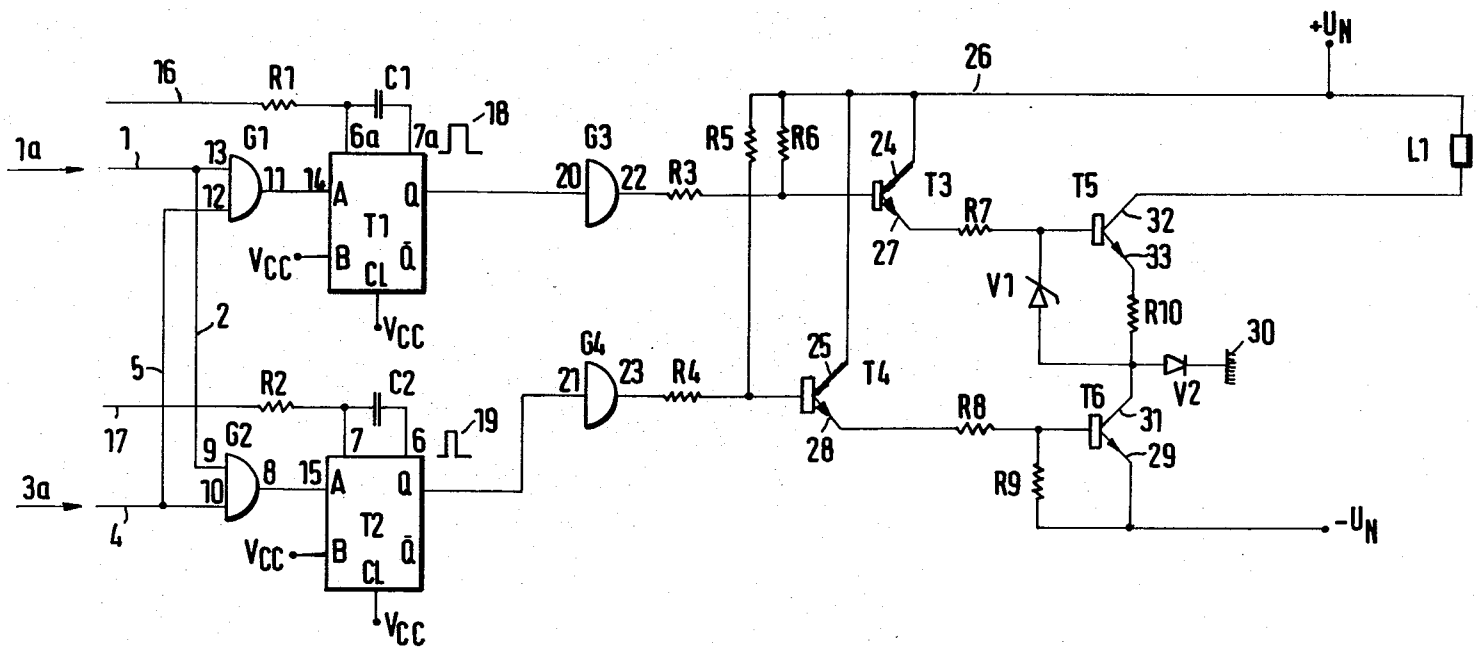
FIG. 1 is a circuit diagram of a drive circuit in accordance with the preferred embodiment of the present invention for practicing the best mode thereof.

These pulses 1*a* and 3*a* together constitute a print command and are respectively fed into the circuit illustrated in FIG. 1, via lines 1 and 4. They are combined in two And gates G1 and G2, whereby the line 1 is connected to the input terminal 13 of gate G1 as well as the input terminal 9 of gate G2, while line 4 is connected to the input terminal 12 of gate G1 and the input terminal 10 of gate G2. In each instance, these gates are enabled by the select signal 1*a*, they produce a coincidence upon occurence of the timing signal 3*a*. Moreover, both gates G1 and G2 respond simultaneously.

The output terminal 11 of gate G1 is connected to the input terminal −A of a monostable multivibrator T1. A second input terminal −B of the monostable device T1 is permanently biased to VCC, being the supply voltage at a level that is usual for IC's such as 5 volts. Analogously, the output terminal 8 of gate G2 is connected to the A input of the second monostable multivibrator T2, having its B input also biased by VCC. The two inputs 6A and 7A of the monostable multivibrator T1 are connected to an RC circuit composed of resistor R1 and capacitor C1. A connecting line 16 for this RC current is biased to the supply voltage. Analogously, the two inputs 6 and 7 of the multivibrator T2 are connected to an RC circuit composed of the resistor R2 and capacitor C2. A common connect line 17 for this RC circuit is also connected to the supply voltage. Each monostable multivibrator has in addition to clear input CL which is permanently biased the VCC. The two monostable multivibrators T1 and T2 furnish output signals of different durations. The output signal pulse 18 of monostable multivibrator T1 is longer than the output pulse 19 of the monostable multivibrator T2, the periods being for example 200 microseconds and 150 microseconds.

Only the Q outputs of the two monovibrators are used whereby the monostable device T1 has its Q output connected to the input terminal 20 of an inverter G3. Analogously, the Q output of the monostable multivibrator T2 is connected to the input 21 of another inverting gate G4. These inverting and amplifier stages G3 and G4 actually match the circuit connection or the IC output to a different voltage level and as compared broadly with the voltage level for directing the circuit elements which have been described thus far. The gates G3 and G4 constitute so-called open collector circuits which means that in one of their respective transistor stages there is an open collector circuit. The collector of this particular output transistor is connected outside of the IC of which all of these elements are a part and to a higher operating voltage via a resistor external to the IC circuit such as R1. The output of an open collector circuit is active low, this means that an output transistor of a gate conducts current only in that instant if that gate is in fact furnishing an output signal. That respective terminal is at ground potential at that time.

The output terminal 22 of gate G3 is connected to the base electrode of a control transistor T3, via a resistor R3. Analogously, the output terminal 23 of the inverter gate G4 is connected to the base electrode of a control transistor T4 via a resistor R4. These base electrodes are additionally connected to a line 26 for being biased by the external positive supply voltage UN being for example, 18 volts. That bias voltage is applied to the base electrodes of T4 and T3 via the resistors R5 and R6, respectively. The resistors R3–R6 and the resistors R4–R5 operate as voltage dividers from which the base voltages are taken for the control transistors.

The emitter electrode 24 of the transistor T3 and the collector electrode 25 of the transistor T4 are both connected to the line 26. The emitter electrode 27 of the transistor T3 is connected to the base electrode of a driver and power transistor T5 via resistor R7. Analogously, the emitter 28 of the transistor T4 is connected to the base electrode of and switching power transistor T6 via the biasing resistor R8. These two transistors T5 and T6 are of the NPN type.

The emitter electrode 29 of the transistor T6 and the base electrode of this transistor, the latter electrode via the resistor R9, are connected to a source of negative voltage UN being for example −36 volts. The collector 31 of transistor T6 is connected via a diode V2 to ground potential 30. In addition, a zener diode V1 is connected between the collector 31 of transistor T6 and the base electrode of transistor T5. A third connection leads from the collector 31 via a reference resistor R10 to the emitter electrode 33 of the transistor T5. The connection is such that the difference in the voltage across the Zener diode and of the voltage drop across resistor R10 is effective on the base-emitter path of the transistor T5. The collector electrode 32 of the transistor T5 is connected directly to one side of the electromagnetic device L1 whose other side is connected to the positive supply voltage +UN. The resistor R10 together with the zener diode V2 constitutes a control circuit for limiting the current through the transistor T5 and the device L1, because the constant voltage drop across the zener diode limits the current through resistor R10 to a constant value.

It is a further advantage that the current limiting circuit, i.e. the driver and switching circuit for the electromagnetic device 1, are mounted on a printed circuit board together with other circuit elements. That printed circuit board is mounted physically remote from the print needle head or the hammer bank in the printer. The heating by and through the current flow through the reference resistor R10 develops therefrom remotely from the mechanical print elements and can be placed suitably within the path of the general cooling structure of the printer without interfering with the sensitive components of the print needle head or the hammer banks.

The circuit as described above operates as follows. A particular cycle or print cycle involving any, some or all of the impact elements of a print head or hammer bank begins with a pair of pulses 1*a* and 3*a* to be applied via the gates G1 and G2 to the two monostable multivibrators T1 and T2. Accordingly, their Q outputs goes high and pulses 18 and 19 are produced. Accordingly, the signal level from the output side of the inverters, 22 and 23, drop and current flows through the resistors R5 and R6 so that the two transistors T3 and T4 are rendered conductive. In addition, current flows from the line 26 through the emitter-collector path of transistor T3, resistor 27 into the base electrode of transistor T5, while a current flows from the line 26 through the emitter-collector path of transistor T4 and the biasing resistor R8 into the base of the power transistor T6. In addition, current flows through the voltage dividing resistor R9 to the source of potential −UN. Therefore, the two power transistors T5 and T6 are both rendered conductive and current through them begins to rise whereby effectively a voltage of −UN/+UN for a total of 54 volts is gradually applied to the electromagnetic device L1.

Figure 2:
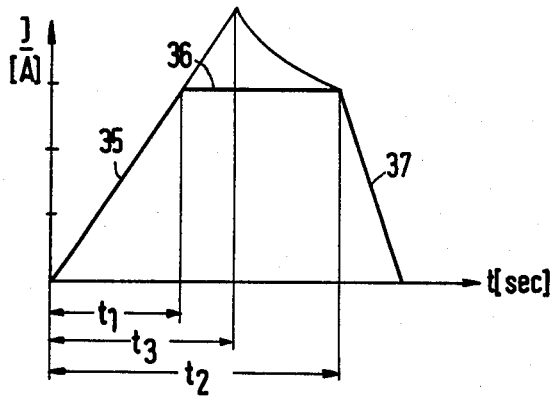
FIG. 2 is a signal diagram illustrating particularly the current flow within the circuit shown in FIG. 1, the current flow being plotted against time.

FIG. 2 illustrates this current increase, it occurs during the time period T1 along the rising flank 35. The current increase is, however, limited through the Zener diode V1 and the reference resistor R10. As soon as the Zener level has been reached on the base or transistor T5 the current flow through the transistor ceases to rise but is limited to the level 36.

The control pulse 19 is shorter than the control pulse 18, and at the time t3 pulse 19 drops to zero; the output of gate 23 goes high and accordingly, transistor T4 is blocked, thereupon current ceases to flow through the switching transistor T6. The operating voltage for the device L1 is therefore limited from this time forward to +UN or 18 volts. Current through the transistor T5 continues to flow from the emitter 33 through the resistor R10 and the diode V2 to ground 30. However, the Zener diode VI remains effective so that the current pulse through the inductance L1 is still limited to the level 36 and does not drop below that level.

At the end of the period T2 the longer one of the two control pulses, namely 18, drops to zero, i.e. the monostable multivibrator T1 reverts to the stable state and the output of the inverter G3 goes up blocking accordingly the transistor T3. Consequently, the current through the inductance L1 drops rapidly along signal flank and trailing edge 37. Since the running down of the load current through the solenoid is a comparatively slow process, particularly as compared with the recovery time of the monostable devices T1 and T2, the next printing pulses 1*a* and 3*a* can appear in fact as soon as the current through the transistor T5 has dropped to zero. In a practical example, the total duration of a printing pulse as identified and represented by the duration of the monovibrator pulse 18 will last about 200 microseconds and the initial rise time t1 for the current in the coil or solenoid L1 is about 100 microseconds. A print cycle thus lasts less than half a millisecond commensurate with a 2000 Hz limit frequency.

The trapezoidal contour of the current pulse can be explained as follows. In the beginning when both control transistors T3 and T4 are conductive, rendering accordingly the transistors T5 and T6 conductive, the transistor T3 tends to apply a fairly high, positive voltage to the base electrode of transistor T5 tending to render it conductive at saturation. On the other hand, the conduction of transistor T6 lowers the potential of the junction of the Zener diode and of the reference resistor R10 more negative than ground, and since the Zener diode V1 before reaching the Zener level acts as a very high resistor, the current limiting circuit operating on the basis of voltage comparison, basically between the Zener diode V1 and the voltage drop across resistor 10, tends to reduce the current rise in the transistor T5 and therefore that circuit tends to limit the rise time of the current through L1 and T5. On the other hand, the trailing edge 37 occurs after the conduction of current through transistor T6 has already ceased (it was turned off at the time t3). Therefore the junction between the Zener diode and the reference resistor R10 is approximately at ground potential. Moreover, the cessation of conduction of transistor t3 at the time T3 together with the change of the potential at the junction of Zener diode D1 and resistor R10 that has occurred, previously causes the rate of decline in current flow through the transistor T5 to steepen as compared with the onset conditions described previously.

Figure 3:
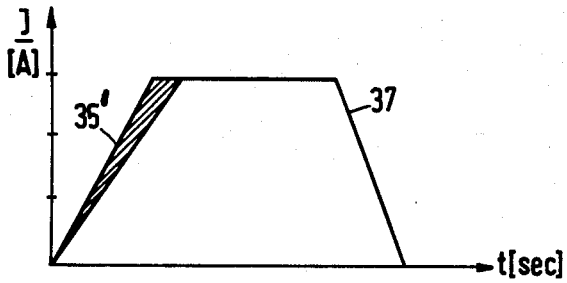
FIG. 3 is another current diagram and compares the effect current limiting has on residual electromagnetic energy and the resulting pulse shape.

As illustrated in FIG. 3, the actual rise time of the pulse is still somewhat steeper, as illustrated by the flank 35'. This is due to the fact that following the interruption of current flow through the coil and inductance L1, there remains a certain residual magnetic energy which steepens the current rise on the next print pulse. No such assisting residual magnetic energy is available for the trailing flank 37. On the other hand it can be seen that due to the steepening of the rising flank on account of this residual energy, the total duration can be made appropriate shorter so that the energization repitition rate benefits accordingly.

Figure 4:
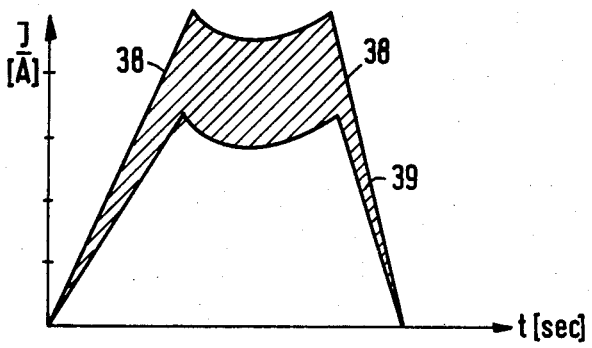
FIG. 4 is also a current diagram plotted against time and demonstrates by comparison the absence of current limiting and the effect of residual energy.

FIG. 4 illustrates particularly in the outer curve 38 a current through the coil, without current limiting but in the presence of residual magnetic energy. The inner curve 39 illustrates the theoretical current curve configuration also without current limiting and without residual energy. One can readily see that the current as per FIG. 3 produces a considerably reduced loss in energy as represented by the hatching and as compared with the hatched area used for comparing the two situations, i.e., with and without residual energy as per FIG. 4. Therefore, the current limiting and the circuit illustrated as per FIG. 1 will not exceed the given current limit and therefore will not consume (short) unneccesary amounts of energy even if some residual electromagnetic energy is still stored in the coil resulting from the previous energization cycle. Consequently, the hatched area as per FIG. 3 illustrates that the convert consumption in the coil L1 is not significantly higher as compared with a current flow without limiting as per FIG. 4. The hatched areas in the two figures illustrate losses which are converted into heat and participate in the heating of the environment. The current limiting as provided reduces these losses accordingly.

The invention is not limited to the embodiments described above; but all changes and modifications thereof, not constituting departures from the spirit and scope of the invention, are intended to be included.

We claim:

1. In a printer such as a matrix printer, a drive circuit for an impact element such as a printing hammer or a print needle, comprising:

an electromagnetic element for activating the impact element;

a series circuit including the electromagnetic element, a first drive transistor and a second switching transistor, the series circuit to be connected between two sources of voltage potential;

two timing members responsive to print signals and producing two pulses of different duration;

a first transistor circuit connected between the timing member furnishing the longer pulse and the base electrode of the drive transistor for controlling conduction thereof;

a second transistor circuit connected between the timing member furnishing the shorter pulse and the base electrode of the switching transistor for controlling conduction thereof; and current limiting control means connected to the series circuit and to the base of the drive transistor for limiting the current flow through the drive transistor and the electromagnetic element, the limiting period beginning after a leading edge and rising of the current, the shorter period terminating during the current pulse, terminating of the longer period terminates the current pulse at a steeper trailing edge.

2. The drive circuit in the printer as in claim 1 comprising, the current limiting control means including a reference resistor connected between the first and the second transistors, and the Zener diode connected across the reference resistor and the base emitter path of the drive transistor.

3. In a printer such as a matrix printer, a drive circuit for an impact element such as a print hammer or a print needle comprising:

an electromagnetic element for activating the impact element;

a transistor having its emitter-collector path connected serially to said electromagnetic element;

logic circuit means connected to receive print command signals;

first circuit means connected to the base of the transistor and to the logic circuit means for operating the transistor in response to a print command as received; and second circuit means connected to the base and emitter electrodes of the transistor for controlling current flow through the transistor to approximate current contour resembling a trapezoid with differently inclined edges so that the current through the electromagnetic element is limited to a value well below a value attainable through the element upon directly applying the same operating voltage without applying the second circuit means, said second circuit means includes a reference resistor connected serially to the emitter of the transistor and a Zener diode connected across a base emitter path of the transistor and the reference resistor, there being additional circuit means for selectively connecting a junction of the Zener diode and of the reference resistor to a source of ground potential or to a source of negative potential, the electromagnetic element being connected to a source of positive potential.

4. A circuit as in claim 3 wherein the additional circuit means includes a switch transistor also connected to the first circuit means being rendered conductive concurrently with the first mentioned transistor upon occurence of a print command, but the switch transistor being rendered nonconductive ahead of rendering nonconductive the first mentioned transistor.

5. In a printer such as a matrix printer, a drive circuit for an impact element such as a hammer or a print needle comprising:

an electromagnetic element for activating the impact element;

a first transistor having its collector-emitter path connected serially to the electromagnetic element;

a reference resistor connected serially to the emitter of the first transistor;

a Zener diode connected across the reference resistor and the emitter base path of the first transistor so that the current flow through the first transistor and the electromagnetic element is limited following the relatively gradual rise in current flow therethrough;

a switching transistor having its collector-emitter path connected serially to the resistor and the diode;

first means for applying a relatively long pulse to the base of the first transistor for rendering the first transistor conductive; and second means for applying a shorter pulse to the base of the switching transistor, the shorter pulse beginning approximately with the longer pulse so that upon occurence of the trailing edge of the long pulse, the second transistor is already nonconductive and the Zener diode and reference resistor cause the current flow through the first transistor and the electromagnetic element to drop rapidly.

6. A circuit for a printer as in claim 5 wherein the first means includes a monostable multivibrator having its output connected to the base electrode of another transistor whose collector-emitter path is connected to the base electrode of the first transistor and wherein the second means includes also a monostable multivibrator having its output connected to the base of still another transistor which in turn has its emitter-collector path connected to the base electrode of the switching transistor.

7. A circuit for a printer as in claim 6 wherein a junction between the switching transistor, the Zener diode and the reference resistor is connected to ground.

* * * * *